US006247708B1

(12) United States Patent
Hsu

(10) Patent No.: US 6,247,708 B1
(45) Date of Patent: Jun. 19, 2001

(54) FOOTWEAR THAT CAN BE WORN FOR WALKING OR SKATING

(76) Inventor: Yi-Chuan Hsu, No. 78, Po Tang Hsia, Yu Hua Li, Miao Li City, Miao Li Hsien (TW)

( * ) Notice: Subject to any disclaimer, the term of this patent is extended or adjusted under 35 U.S.C. 154(b) by 0 days.

(21) Appl. No.: 09/433,710

(22) Filed: Nov. 4, 1999

(30) Foreign Application Priority Data

Oct. 12, 1999 (TW) ..... 88217256

(51) Int. Cl.[7] ..... A63C 17/20

(52) U.S. Cl. ..... 280/11.223; 280/11.27; 280/7.13

(58) Field of Search ..... 280/7.12, 7.13, 280/7.14, 11.19, 11.223, 11.232, 11.27, 11.28, 87.042, 825

(56) References Cited

U.S. PATENT DOCUMENTS

| | | | | |
|---|---|---|---|---|
| 2,095,942 | * | 10/1937 | Wetterstrand | 280/841 |
| 3,281,971 | * | 11/1966 | Weitzner | 280/7.13 |
| 3,884,485 | * | 5/1975 | Walle | 280/841 |
| 3,983,643 | * | 10/1976 | Schreyer et al. | 280/11.19 |
| 4,150,499 | * | 4/1979 | Wang | 280/7.13 |
| 5,398,970 | * | 3/1995 | Tucky | 280/11.27 |
| 5,511,824 | * | 4/1996 | Kim | 280/11.27 |
| 5,595,392 | * | 1/1997 | Casillas | 280/7.13 |
| 5,797,609 | * | 8/1998 | Fichepain | 280/11.27 |
| 5,887,898 | * | 3/1999 | Petrosino | 280/825 |
| 6,086,072 | * | 7/2000 | Prus | 280/11.28 |
| 6,120,039 | * | 7/2000 | Clementi | 280/11.19 |

FOREIGN PATENT DOCUMENTS

| | | | | |
|---|---|---|---|---|
| 309567 | * | 10/1918 | (DE) | 280/7.13 |
| 2550211 | * | 5/1976 | (DE) | 280/841 |

* cited by examiner

*Primary Examiner*—Frank Vanaman
(74) *Attorney, Agent, or Firm*—Browdy & Neimark

(57) ABSTRACT

An article of footwear is designed for use as a walking shoe and a roller skate and is composed of a main body, a sole disposed in the bottom of the main body and provided with a plurality of cells, a plurality of wheel sets disposed in the cells and formed of a wheel seat, two swivel arms, a wheel, an adjustment member, and a locating member. The wheel seat is fastened with the top of the corresponding cell. The two swivel arms are fastened pivotally with two sides of the wheel seat by a pivot. The wheel is pivoted between the two swivel arms by an axle. The adjustment member is connected with one swivel arm. The locating member is connected with other swivel arm for locating the swivel arm at a predetermined angular position. The wheel is thus located at its extraction position by the locating member.

5 Claims, 4 Drawing Sheets

FOOTWEAR THAT CAN BE WORN FOR WALKING OR SKATING

FIELD OF THE INVENTION

The present invention relates generally to a footwear, and more particularly to a footwear that is designed for use as a walking shoe as well as an article of roller skate.

BACKGROUND OF THE INVENTION

As shown in FIG. 1, an article of prior art roller skate is provided with a sole plate 1 which is in turn provided in the front end thereof and the rear end thereof with a protruded portion 2. A sole 3 is attached to the underside of the sole plate 1 and is provided with two receiving cells 4 corresponding in location to the protruded portions 2 of the sole plate 1. Two roller seats 5 are provided with a roller base seat 6, a pivoting seat 7 mounted on the roller base seat 6, and a roller 8 mounted on the pivoting seat 7. The two roller base seats 6 are located in the receiving cells 4. The roller 8 can be extracted out of or retracted into the sole 3 for skating or walking. When the roller 8 is jutted out of the sole 3, the pivoting seat 7 is in contact with the protruded portion 2 of the sole plate 1 so as to support the body weight of a wearer of the prior art roller skate.

Such a prior art roller skate as described above is defective in design in that the roller is extracted out of or retracted into the receiving cell 4 with finger, which is thus prone to become dirty. In addition, the diameter of the axle of the roller 8 is limited by the thickness of the pivoting seat 7, thereby resulting in the incompatibility of the axle with the rollers of various sizes. Moreover, the height of the roller 8 can not be appropriately adjusted to enable the prior art roller skate to be used effectively as a walking shoe as well as a roller skate.

SUMMARY OF THE INVENTION

The primary objective of the present invention is to provide a footwear which can be effectively used as a walking shoe or roller skate and is free from the deficiencies of the prior art roller skate described above.

In keeping with the principle of the present invention, the foregoing objective of the present invention is attained by an article of footwear comprising a main body, a sole attached to the bottom of the main body and provided in the underside thereof with a plurality of cells, a plurality of wheel set members which are disposed in the cells and are formed of a wheel seat, two swivel arms, a wheel, an adjustment member, and a locating member. The wheel seat is fixed with the top of the cells. The two swivel arms are fastened pivotally with the wheel seat by means of an article of pivot. The wheel is pivoted between the two swivel arms. The adjustment member is connected with one swivel arm and located at one side of the sole. The wheel can be swiveled out of or into the sole by turning the two swivel arms. The locating member is connected with other swivel arm and located at other side of the sole for locating the two swivel arms. The angle at which the swivel arms are swiveled is adjusted by the adjustment member. After the swivel arms are swiveled at a predetermined angle, the swivel arms are located by the locating member so as to locate securely the wheel which is jutted out of the sole.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
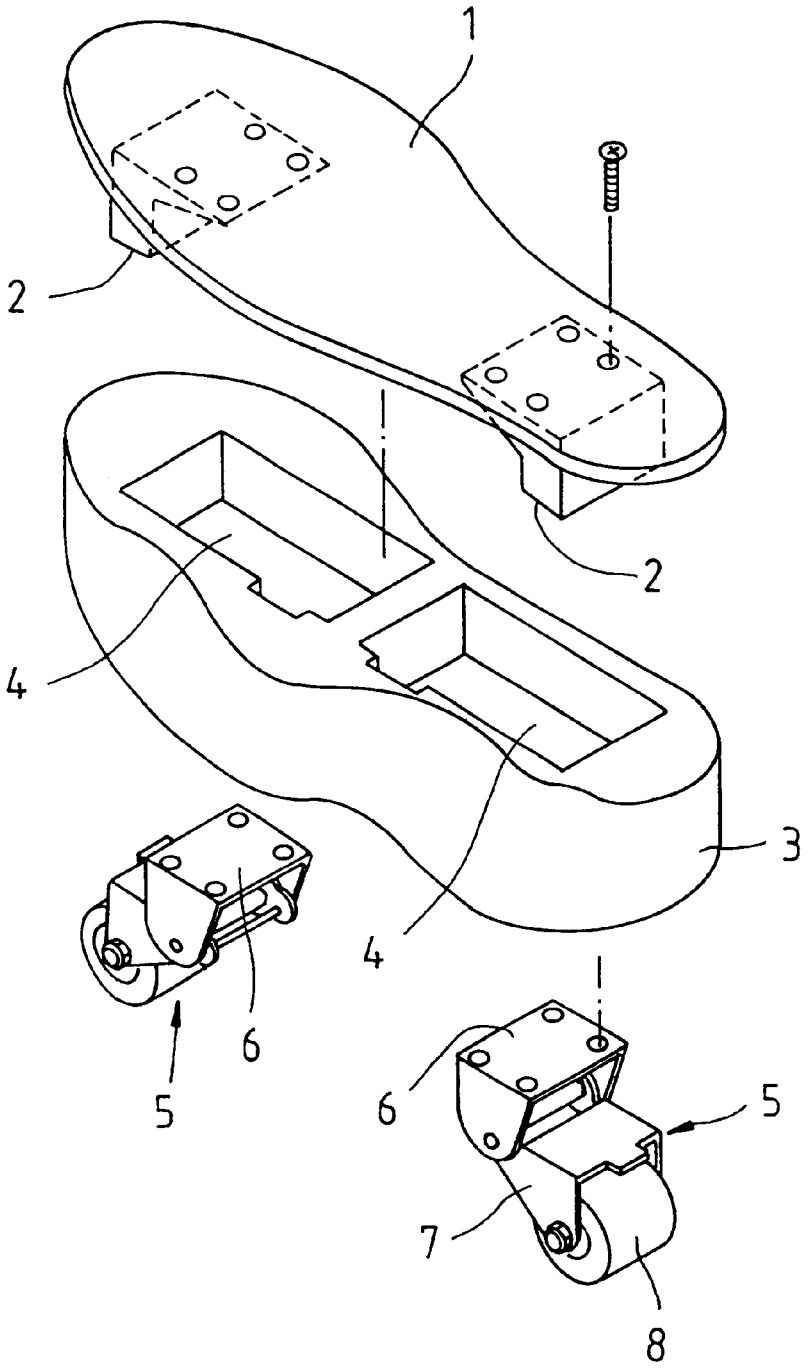
FIG. 1 PRIOR ART
FIG. 1 shows a prior art article of footwear having rollers for skating.
Figure 2:
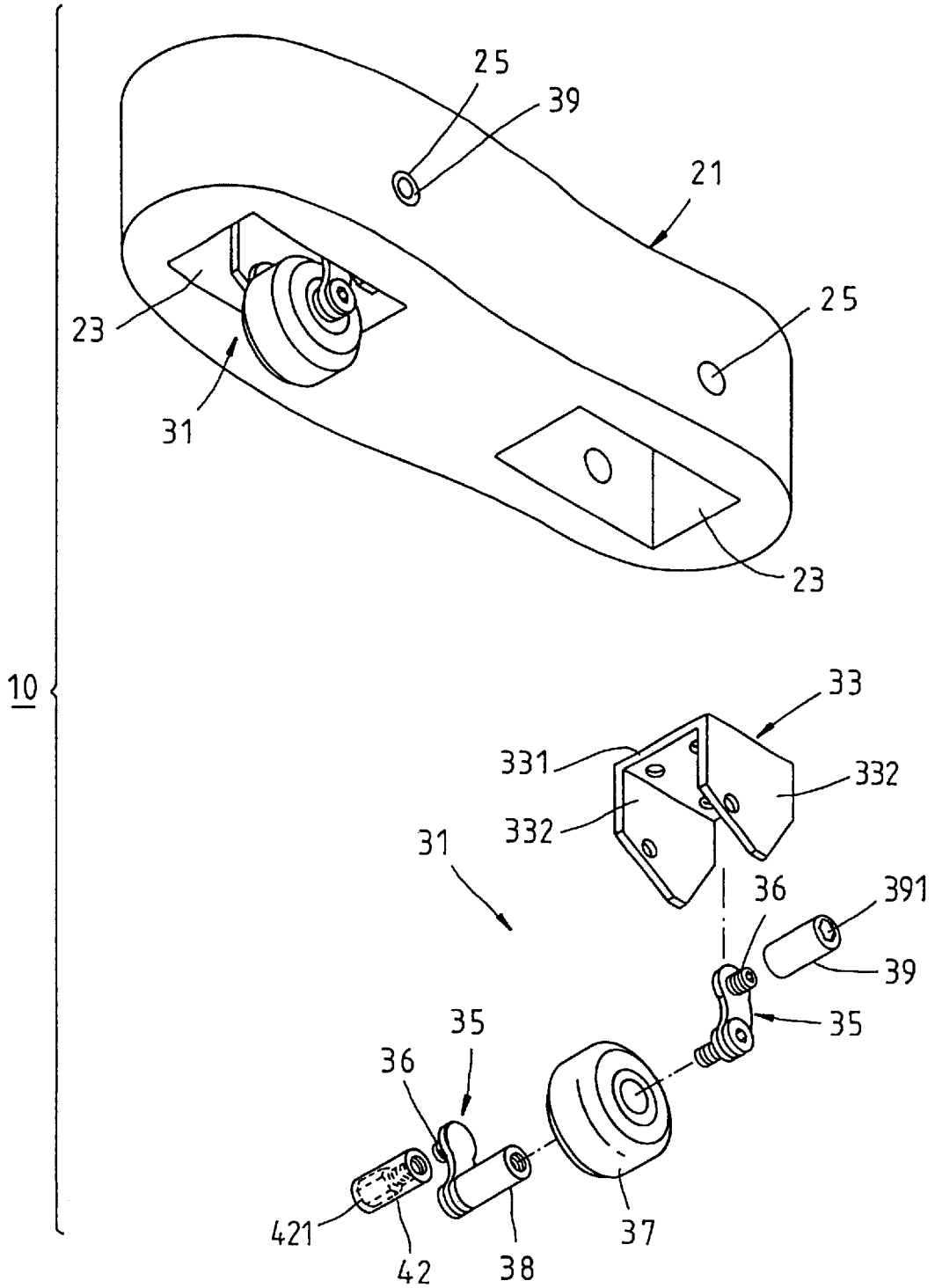
FIG. 2 shows an exploded view of a first preferred embodiment of the present invention.
Figure 3:
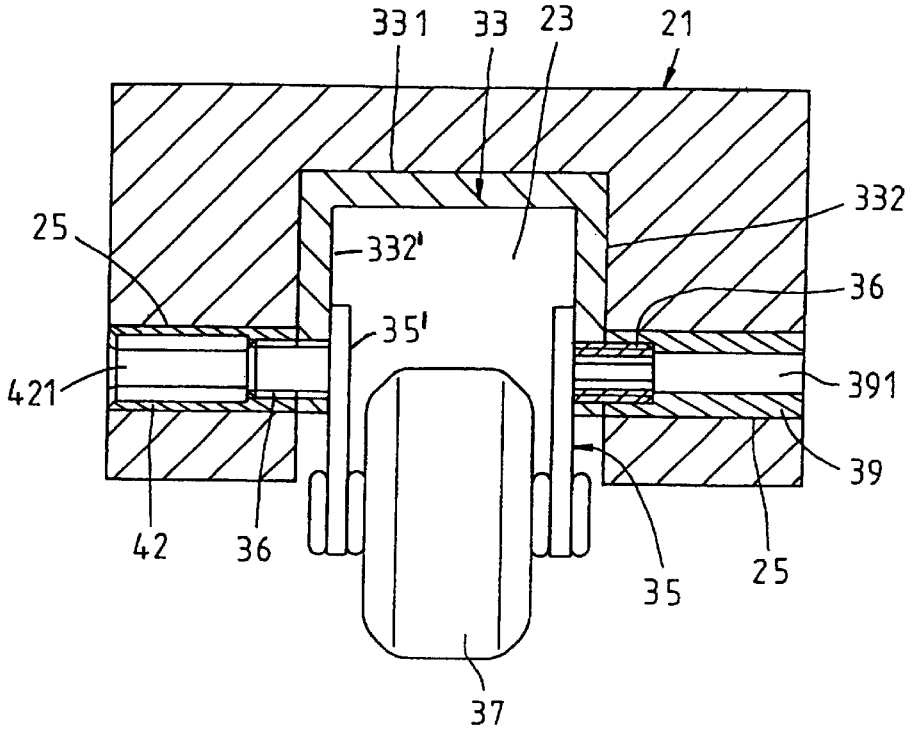
FIG. 3 shows a cross-sectional view of the first preferred embodiment of the present invention in combination.
Figure 4:
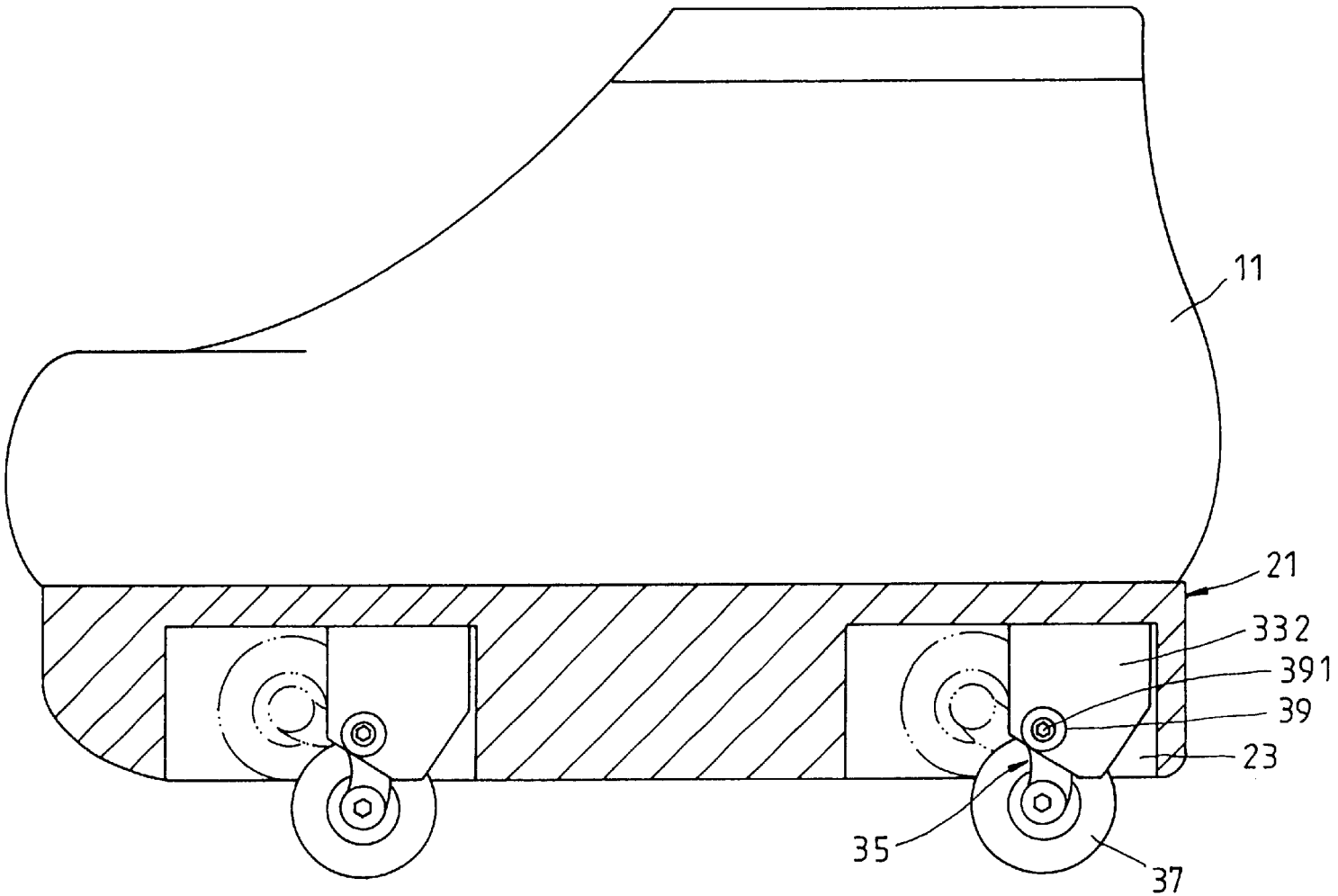
FIG. 4 shows a schematic view of the first preferred embodiment of the present invention at work.

As shown in FIGS. 2–4, an article of footwear 10 of the present invention comprises a main body 11, a sole 21, and two wheel sets 31.

The sole 21 is provided in the front section and the rear section of the underside thereof with a cell 23. The sole 21 is further provided in two side walls thereof with a through hole 25 in communication with the cell 23.

The wheel sets 31 are corresponding in location to the cells 23 and are composed of a wheel seat 33, two swivel arms 35, 35' a wheel 37, an adjustment member 39, and a locating member 42.

The wheel seat 33 has an inverted U-shaped cross section, a base plate 331, and a side plate 332 extending downward from two sides of the base plate 331. The wheel seat 33 is fixed on the top of the cell 23 by means of the base plate 331.

The two swivel arms 35, 35' are pivotally fastened with the side plates 332, 332' of the wheel seat 33 by a pivot 36 which is received in the through hole 25 and located in the side wall of the sole 21.

The wheel 37 is pivotally mounted on an axle 38 which is fastened between the two swivel arms 35.

The adjustment member 39 is a sleeve, which is put into the through hole 25 of one side of the sole and is fastened with the pivot 36 of swivel arm 35. The adjustment member 39 is provided with an inner hexagonal slot 391 engageable with a hexagonal wrench by which the two swivel arms 35 are actuated to swivel so as to adjust the angular position of the wheel 37.

The locating member 42 is a sleeve, which is received in the through hole 25 of the other side of the sole and is fastened with the pivot 36 of the other swivel arm 35, such that the locating member 42 (the sleeve) comes in contact with side wall 332' of wheel seat 33. The locating member 42 is provided with an inner hexagonal slot 421 engageable with a hexagonal wrench by which locating member 42 can be turned and tighten swivel arm 35' against side wall 332' so as to locate swivel arm, thereby locating the wheel 37 at the angular position.

As shown in FIGS. 3 and 4, when the wheels 37 are retracted into the cells 23 of the sole 21, as shown by the imaginary lines, the footwear 10 of the present invention can be worn for walking. The article of footwear 10 can be used as a roller skate by unfastening the locating member 42 to free swivel arm 35 corresponding to the locating member 42. By using a hexagonal wrench (not shown in the drawings) to engage the inner hexagonal slot 391 of the adjustment member 39, the swiveling position of the swivel arms 35, 35' is adjusted. As a result, the angular position of the wheel 37 is adjusted such that the wheel is extracted out of the cell 23 of the sole 21 to an extent that is desired. Thereafter, the hexagonal wrench is engaged with the inner hexagonal slot 421 of the locating member 42 to tighten the locating member 42 so as to fix the wheel 37 at the desired angular position. The wheels 37 can be once again retracted into the cells 23 by unfastening the locating members 42 as described above.

It must be noted here that the hexagonal slot of the locating member 42 of the present invention may be replaced by the slots of other geometric forms.

Figure 5:
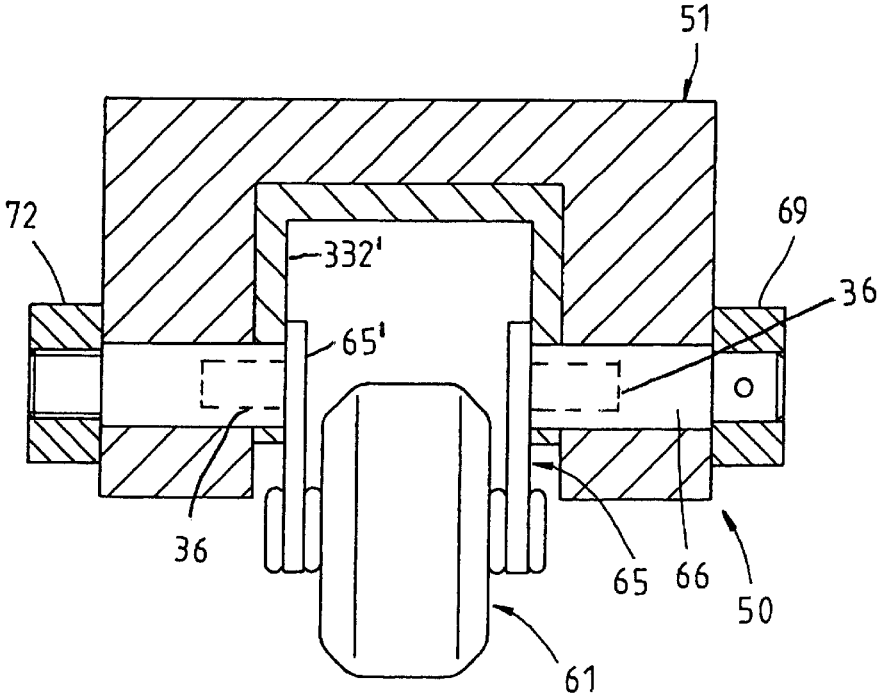
FIG. 5 shows a cross-sectional view of a second preferred embodiment of the present invention in combination.

As shown in FIG. 5, an article of footwear 50 of the second preferred embodiment of the present invention is basically similar in construction to the footwear 10 of the first preferred embodiment of the present invention, with the difference being that the article of footwear 50 comprises the wheel sets 61, with each having two swivel arms 65, 65' which are fastened by pivots 36 to a pivot 66 which is put through and beyond two side walls of the sole 51 and wheel seat 33 and is provided with an adjustment member 69 fastened therewith. The adjustment member 69 is a rotary button and is greater in diameter than the pivot 66. The rotary button 69 can be easily turned with hand to actuate the two swivel arms 65, 65'. The locating member 72 is also a rotary button, which is connected with other pivot 66 and is greater in diameter than the other pivot 66. The locating member 72 comes in contact with the side wall of the sole such that the locating member 72 can be turned with hand to tighten swivel arm, 65' corresponding pivot 36 against side wall 332'. As a result, the wheel 67 of the wheel sets 61 can be located. The second preferred embodiment of the present invention can be used without the help of a hand tool such that the adjustment member or the locating member 72 is manually rotated to locate the angular position of the wheel.

The present invention has advantages, which are described hereinafter.

The height of the wheel of the present invention is adjusted from the side of the sole, without using the finger to catch the wheel so as to keep one's finger clean.

The space between the wheel seat and the swivel arms of the present invention is greater than that of the prior art, thereby making the present invention compatible with the wheels of various sizes.

The height of the wheel of the present invention is adjustable, depending on the need of a person as well as the skating skill of the person.

The wheels of the present invention can be adjusted such that the front wheel is different in height from the rear wheel. In other words, the present invention is relatively more versatile in design than the prior art.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An article of footwear comprising:

a main body;

a sole engaged to a bottom of said main body and provided in an underside thereof with a plurality of cells;

a wheel set disposed in each of said cells having a wheel seat, a first and second swivel arm, a wheel, an adjustment member and a locating member;

said wheel seat being fixed to a top of each of said cells;

said first and second swivel arm each being rotatable together on pivots respectively extending through two opposite side walls of said wheel seat;

said wheel being rotatable between said first and second swivel arm on an axle;

said adjustment member being fastened to the pivot on the first swivel arm and said locating member threadingly fastened to the pivot on the second swivel arm to releasably fasten the second swivel arm to the corresponding side wall of the two opposite side walls of the wheel seat;

wherein when said locating member is turned to unfasten the second swivel arm from the corresponding side wall of the wheel seat, the adjustment member can be turned to rotate the wheel into and out of the corresponding cell of said cells and thereafter fixed in a selected position by refastening the locating member.

2. The article of footwear according to claim 1, wherein both the adjustment member and the locating member are sleeves which are respectively recessed and rotatable within opposite side walls of the sole.

3. The article of footwear according to claim 2, wherein a hexagonal slot is provided in each free end of the sleeves to facilitate rotating the sleeves from outside the sole.

4. The article of footwear according to claim 1, wherein both the adjustment member and the locating member are sleeves that have ends which respectively extend outside opposite side walls of the sole; and wherein the locating member has a first rotary button fastened on one of the ends which can be turned to releasably fasten the second swivel arm to the corresponding side wall of the wheel seat and the adjustment member has a second rotary button which can rotate the first and second swivel arm when the second swivel arm is unfastened.

5. The article of footwear according to claim 1, wherein said wheel seat has an inverted U-shaped cross section, a base plate, and a side wall extending downward from two sides of said base plate; wherein said wheel seat is fastened with the top of said cells of said sole by said base plate.

* * * * *